US006722415B2

(12) United States Patent
Mochizuki et al.

(10) Patent No.: US 6,722,415 B2
(45) Date of Patent: Apr. 20, 2004

(54) SHUTTER PANEL

(75) Inventors: Masanori Mochizuki, Yao (JP); Kenji Mochizuki, Yao (JP)

(73) Assignee: Isel Co., Ltd. (JP)

( * ) Notice: Subject to any disclaimer, the term of this patent is extended or adjusted under 35 U.S.C. 154(b) by 0 days.

(21) Appl. No.: 09/989,062

(22) Filed: Nov. 21, 2001

(65) Prior Publication Data

US 2002/0059988 A1 May 23, 2002

(30) Foreign Application Priority Data

Nov. 22, 2000 (JP) ..... 2000-355880

(51) Int. Cl.[7] ..... E05D 15/06
(52) U.S. Cl. ..... 160/235
(58) Field of Search ..... 160/235, 232, 160/236, 183, 199, 201

(56) References Cited

U.S. PATENT DOCUMENTS 3,056,451 A * 10/1962 Ferderline et al. ..... 160/201
3,169,612 A * 2/1965 Wolf et al. ..... 160/201
4,922,987 A * 5/1990 Marontate et al. ..... 160/183
5,150,501 A * 9/1992 Pasternak ..... 160/199 X
5,363,616 A * 11/1994 Hernandez ..... 160/199 X
5,458,179 A * 10/1995 Magaldi et al. ..... 160/183
5,729,867 A * 3/1998 Carmichael ..... 160/235 X
5,857,510 A * 1/1999 Krupke et al. ..... 160/201

FOREIGN PATENT DOCUMENTS

FR 559647 9/1923 ..... E06B/9/15
WO WO 00/57016 9/2000 ..... E06B/9/58

* cited by examiner

*Primary Examiner*—David M. Purol
(74) *Attorney, Agent, or Firm*—Fitch, Even, Tabin and Flannery

(57) ABSTRACT

A shutter panel (10) in which respective longer sides of slats (12) made of synthetic resin are connected through hinge mechanisms to be freely bendable manner, wherein the hinge mechanisms include one hinge member and another hinge member. Each hinge member has a connecting groove that is opened outwardly. By fitting and coupling the longer sides of the slats into the connecting grooves respectively, smooth opening and closing of the shutter panel (10) can be performed because of decreasing warpage or irregularities in thickness of slats (12) or the hinge members and enabling smooth bending of respective slats (12) connected by the hinge mechanisms.

12 Claims, 10 Drawing Sheets

SHUTTER PANEL

BACKGROUND OF THE INVENTION

1. Field of the Invention

The present invention relates to a shutter panel. More particularly, it relates to a shutter panel in which a plurality of slats is connected in an aligned manner to be freely bendable by means of hinge mechanisms.

2. Disclosure of the Prior Art

A shutter for opening and closing an aperture of a processing chamber installed with mechanical tools or an entrance of a building has already been proposed in an invention filed as Japanese Patent Application No. 2000-292689, and an embodiment thereof is a shutter of an arrangement as shown in FIG. 12.

In such an arrangement, both right and left ends of the shutter panel (10) obtained by connecting a plurality of slats (12) in an aligned manner to be freely bendable are held by guide rails (19) in a freely sliding manner, wherein an inner tube (16*b*) having a circular section and serving as a hinge member projects from one longer side of each slat (12) while an outer tube (16*a*) having a C-shaped section projects out from the other side of the slat (12). The outer tube (16*a*) can be outwardly fitted onto the inner tube (16*b*) in a freely rotating manner. The slat (12), the inner tube (16*b*) and the outer tube (16*a*) are integrally formed of a synthetic resin material.

With this arrangement, respective adjoining slats (12) are connected in a freely bendable manner by fitting the outer tube (16*a*) of one of the slats (12) to the inner tube (16*b*) of an oppositely disposed another slat (12) to be freely rotating. By sequentially performing these connecting processes, it is possible to complete the shutter panel (10) in which a plurality of slats (12) is connected in a freely bendable manner. When these right and left ends of the shutter panel (10) are held by a pair of guide rails (19) that are oppositely disposed at the aperture or the entrance, the aperture or the entrance may be closed and opened freely by means of the shutter panel (10).

However, since the slats (12), inner tubes (16*b*) and outer tubes (16*a*) were integrally formed of a synthetic resin material in the above prior art, the integrally molded body will shrink as a whole at the time of cooling and hardening of the resin immediately after the molding. Accumulation of shrinkage of all parts of the slats (12), the inner tubes (16*b*) and the outer tubes (16*a*) will easily lead to occurrence of dimensional errors, warpage or local irregularities in thickness of the entire integrally molded body. Accompanying such warpage or irregularities in thickness, it may happen that the outer tubes (16*a*) and inner tubes (16*b*) of adjoining slats (12) may not fit in a coaxial manner at high accuracy so as to prevent smooth relative rotation of the inner tubes (16*b*) and outer tubes (16*a*). Drawbacks were accordingly caused in that respective adjoining slats (12) could not be freely bend or in that the shutter panel (10) could not be smoothly opened and closed.

SUMMARY OF THE INVENTION

It is an object of the present invention to provide a shutter panel in which respective the longer sides of adjoining slats that are made of synthetic resin are connected by means of hinge mechanisms to be freely bendable, wherein smooth bending of the respective slats that are connected by the hinge mechanisms is enabled such that the shutter panel can be smoothly opened and closed by reducing warpage or irregularities in thickness of the slats or the hinge members for connecting these slats.

The shutter panel according to the present invention, which has been made for achieving the above objects, is characterized in that the hinge mechanisms include one hinge member and another hinge member, wherein each hinge member has a connecting groove that is opened outwardly, wherein the longer sides of the slats are fitted and coupled into and engaged with the connecting grooves respectively.

By fitting and coupling one of the longer sides of the slat with connecting groove of one of the hinge members while by fitting and coupling the other longer side of the slat with connecting groove of another hinge member, both hinge members are coupled to the both sides of the slat. By sequentially connecting a plurality of slats by using the hinge mechanisms included of both of these hinge members, the shutter panel is completed.

Since the respective hinge members and slats are constituted as separate members, warpage or local irregularities in thickness may be reduced that were caused through cooling and shrinkage after molding when compared to the above-described prior art in which all of these parts were molded in an integral manner.

Since warpage or irregularities in thickness of the respective parts owing to shrinkage by cooling may be prevented, it is further possible to prevent surfaces of the slats from slightly becoming wavy in case the slats are formed of transparent resin material, the transparency of the slats may be improved by reducing indiscriminate scattering of light hitting on the slats.

Because of the above arrangement, the present invention exhibits the following unique effects.

Since the slats and the hinge members are constituted as separate parts, the degree of shrinkage by cooling of resin at the time of molding can be reduced when compared to the prior art in which they were integrally molded so as to reduce warpage and local irregularities in thickness of the respective parts. Accordingly, respective adjoining slats may be connected by the hinge members to be smoothly bendable and warpage or torsion in the entire shutter panel may be prevented, and it is possible to smoothly open and close the shutter panel.

Other objects, features, aspects and advantages of the invention will become more apparent from the following detailed description of embodiments with reference to the accompanying drawings and appended claims.

DETAILED DESCRIPTION OF THE INVENTION

Embodiments of the present invention will now be explained with reference to the drawings.

(First Embodiment)

Figure 1:
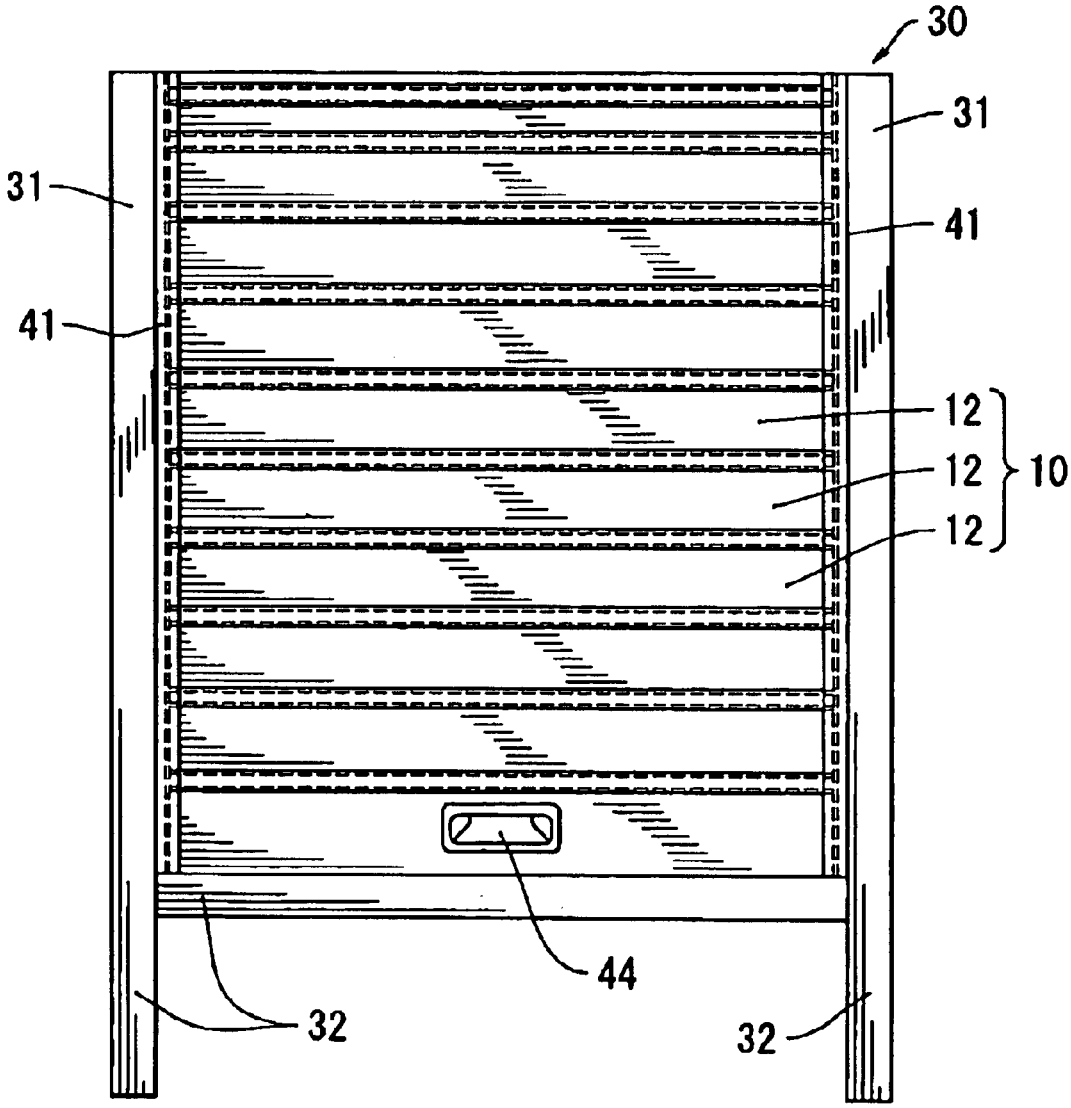
FIG. 1 is a front view of a housing (30) for machine tools to which the shutter according to a first embodiment of the present invention is applied.
Figure 2:
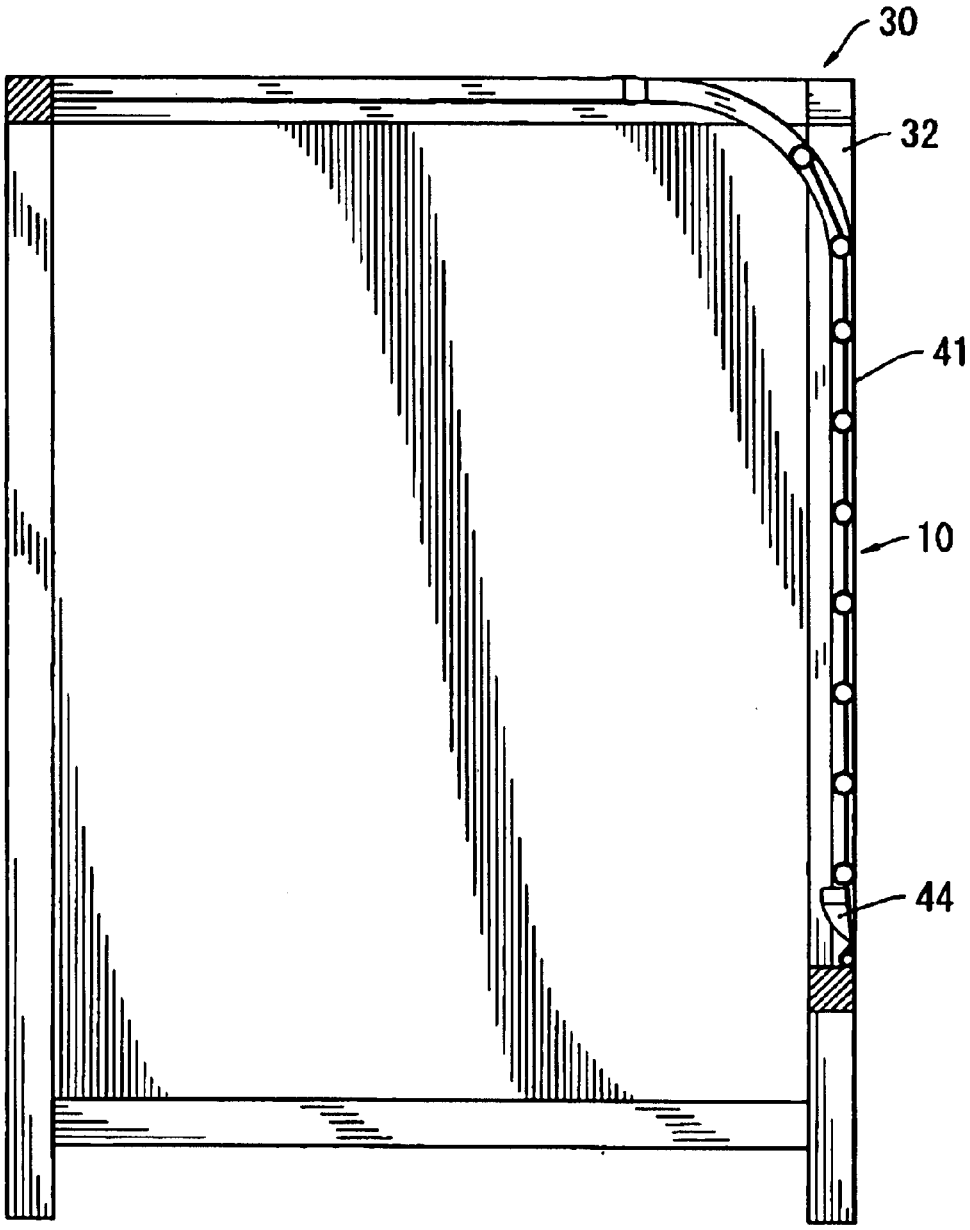
FIG. 2 is a longitudinal sectional view of the housing (30) of FIG. 1.

FIGS. 1 and 2 illustrate a shutter provided with the shutter panel according to the first embodiment of the present invention. The shutter panel (10) according to this embodiment is disposed to open and close an aperture of a housing (30), which is to serve as a processing chamber installed with mechanical tools, by being formed to extend from a front surface to an upper surface thereof, and both end edges of the shutter panel (10) are held by a pair of right and left guide rails (41), which are mounted to a frame body (32) of the housing (30), to be freely sliding in vertical directions.

The shutter panel (10) includes a plurality of slats (12) made of transparent synthetic resin and hinge members including an inner tube (16*b*) and outer tube (16*a*) that are attached to longer sides of the slats (12) respectively for connecting the longer sides of adjoining slats to be freely bendable each other.

Figure 3:
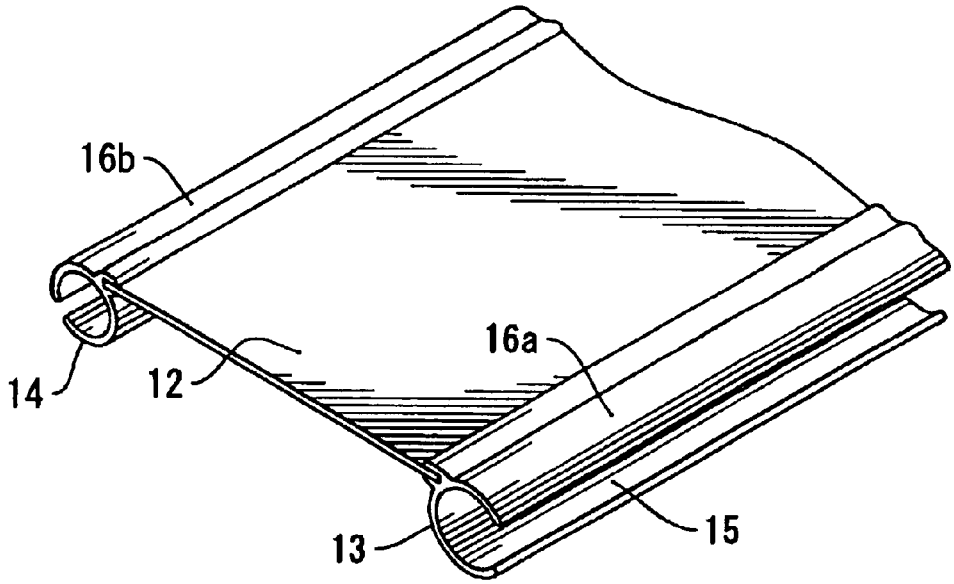
FIG. 3 is a partial perspective view showing a condition in which an inner and outer tube (16*b*)(16*a*) are mounted onto a slat (12).
Figure 4:
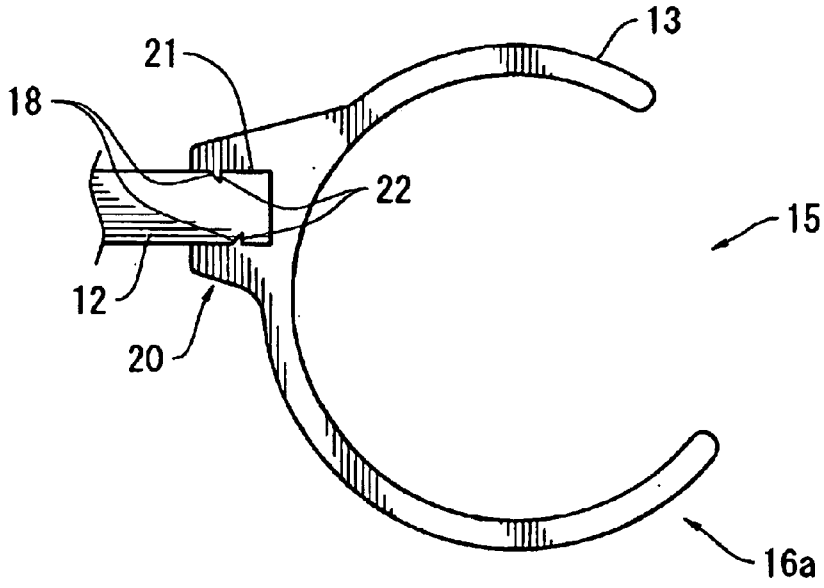
FIG. 4 is an enlarged end view of a portion at which the outer tube (16*a*) is disposed.

As illustrated in FIGS. 3 and 4, the outer tube (16*a*) is a tubular body made of aluminum alloy with a C-shaped section, and is provided with a cylindrical main body (13) and a mounting block (20) having a connecting groove (21) on an outer peripheral surface thereof to project in an axial direction.

On opposing inner surfaces of a pair of projected pieces that constitute the connecting groove (21), engaging ribs (22) with triangular sections are formed to protrude from the entire connecting groove (21) along the axial direction to serve as protrusions for preventing slipping off. Engaging grooves (18) engaging with the ribs (22) are formed on front and back surfaces of the slat (12) along the longer side direction, wherein the sectional shape of the engaging grooves (18) is set to be somewhat smaller than the sectional shape of the engaging ribs (22).

With this arrangement, in case the longer sides of the slats (12) are inserted into the connecting grooves (21) of the mounting blocks (20) respectively, the engaging ribs (22) formed to project from opposing inner surfaces of the connecting grooves (21) are forcibly fitted with the engaging grooves (18) of the slats (12) so that the slats (12) are further inserted into the connecting grooves (21) in the fitted condition. At this time, since the engaging ribs (22) made of aluminum alloy cut into the front and rear surfaces of the slats (12) while slightly scraping inner surfaces of the engaging grooves (18) of the slats (12) made of synthetic resin that are formed to be slightly smaller, the engaging ribs (22) and engaging grooves (18) are fitted closely. In this condition, the mounting blocks (20) and slats (12) are fixedly attached through means such as high frequency welding or adhesive or the like.

The engaging grooves (18) that are formed on the front and rear surfaces of the slats (12) respectively are provided such that they are slightly shifted each other in shorter side directions of the slats (12). The reason for such an arrangement is that the thickness of the slats (12) at which the engaging grooves (18) are formed will become thinner to cause degradation in strength if the engaging grooves (18) on the front and rear surfaces would be formed at positions that are remote from the ends of the longer sides of the slats (12) by the same distance.

Figure 5:
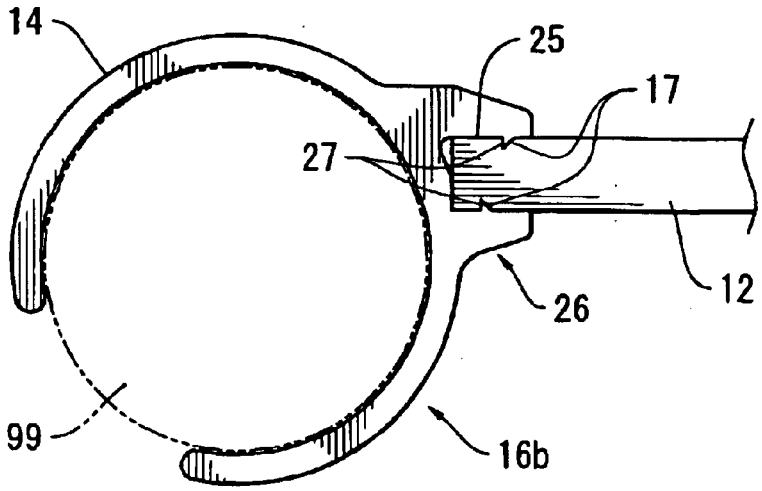
FIG. 5 is an enlarged end view of a portion at which the inner tube (16*b*) is disposed.

The inner tube (16*b*) is a tubular body made of aluminum alloy having a C-shaped section as illustrated in FIGS. 3 and 5, and is provided, similar to the outer tube (16*a*), with a cylindrical main body (14) and a mounting block (26) having a connecting groove (25) on an outer peripheral surface thereof to project in an axial direction, and is disposed on the other longer side of the slat (12) that is an opposite side attached the outer tube (16*a*). It should be noted that the inner tube (16*b*) might alternatively be of simple cylindrical shape.

The mounting block (26) is similarly arranged as the above-described mounting block (20) of the outer tube (16*a*), and engaging ribs (27) with triangular sections are formed to protrude along the axial direction of the inner tube (16*b*) on opposing inner surfaces of a pair of projected pieces that form the connecting groove (25). The relationship between the engaging ribs (27) and the engaging grooves (17) of the slats (12) are similar to those of the above-described outer tube (16*a*), and upon close fitting of the engaging ribs (27) into the engaging grooves (17) while cutting into the slats (12), they are fixedly attached through means such as high frequency welding or adhesive or the like.

The engaging grooves (17) are also formed at positions at which they are slightly shifted with respect to each other in shorter side directions owing to the same reason as that of the above-described outer tube (16*a*).

Figure 6:
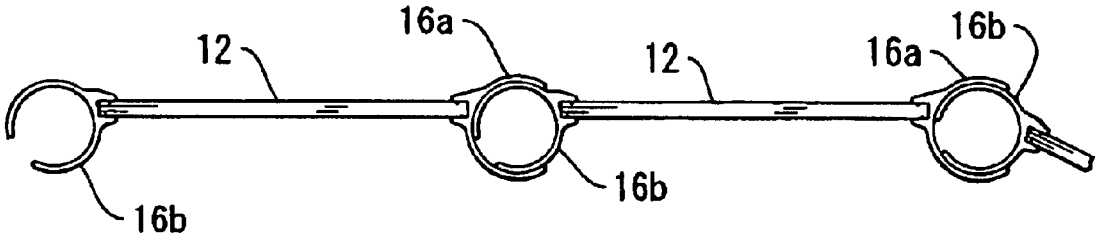
FIG. 6 is an explanatory view illustrating a condition in which the slats (12) are connected.
Figure 7:
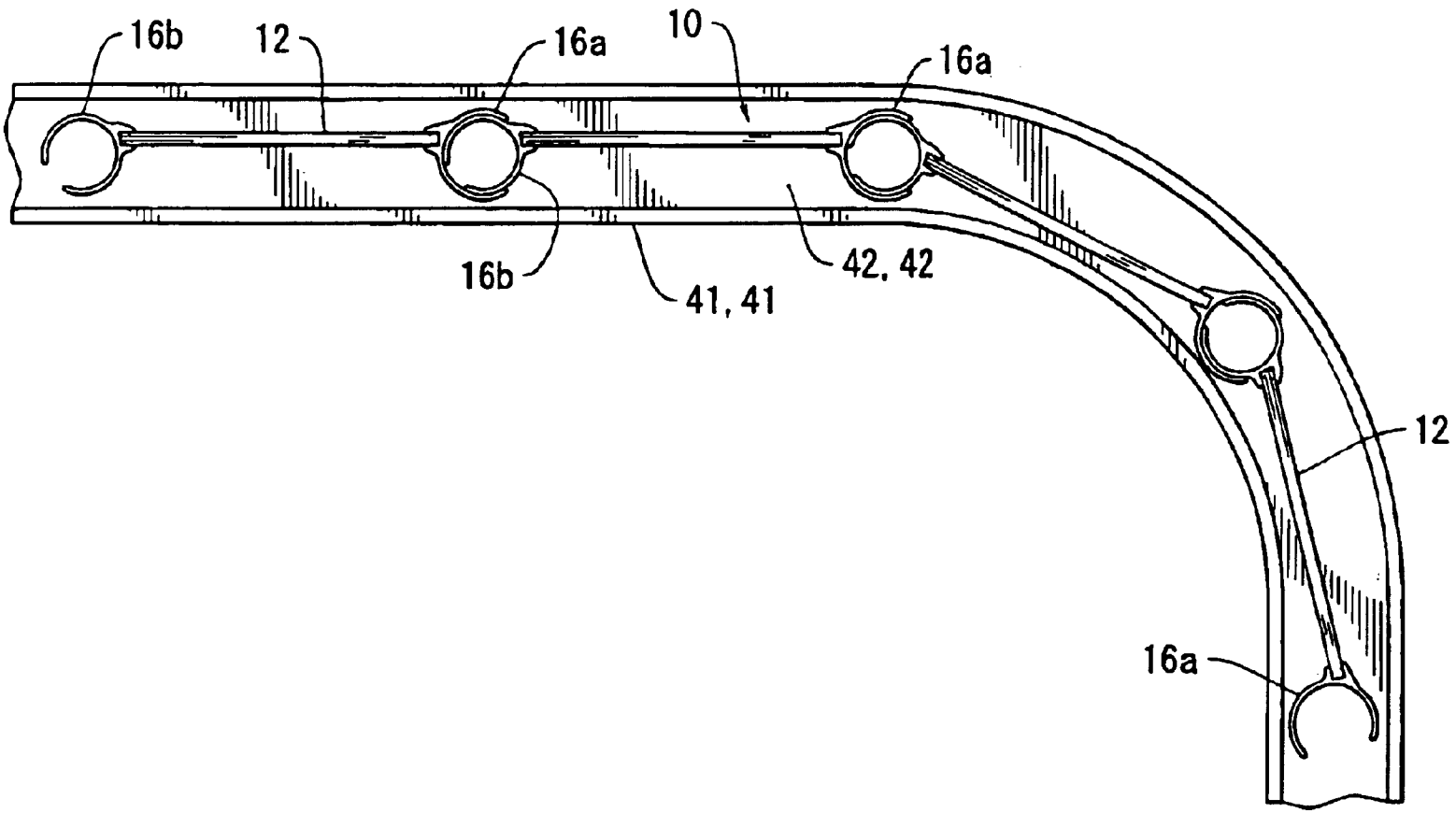
FIG. 7 is an explanatory view illustrating a condition in which the shutter panel (10) is assembled to guide grooves (42).

An outer diameter of the cylindrical main body (14) of the inner tube (16*b*) is set to be slightly smaller than an inner diameter of the cylindrical main body (13) of the outer tube (16*a*) so as to provide an arrangement in which the inner tube (16*b*) is inwardly fitted into the outer tube (16*a*) as illustrated in FIG. 6 wherein the outer tube (16*a*) and inner tube (16*b*) may freely rotate each other in a coaxial condition with the outer tube (16*a*) partially concentrically surrounding the inner tube (16*b*). When fitting the inner tube (16*b*) and the outer tube (16*a*) in a freely rotating manner, the mounting block (26) of the inner tube (16*b*) is set to project outwardly through the aperture (15) formed along the axial direction of the cylindrical main body (13) of the outer tube (16*a*). An aperture width for the aperture (15) and a thickness of the mounting block (26) are set such that the outer tube (16*a*) and the inner tube (16*b*) are allowed to relatively rotate by a certain angle.

For connecting the slats (12) by using hinge members that are formed of these inner tubes (16*b*) and outer tubes (16*a*), the inner tubes (16*b*) are attached to one of the longer sides of the slats (12) while outer tubes (16*a*) are attached to the other side as illustrated in FIGS. 3 and 6. More particularly, the longer sides of the slats (12) are forcibly fitted into the connecting grooves (25)(21) of the mounting blocks (26) (20) that are formed to project from the outer peripheral surfaces of the inner tubes (16*b*) and outer tubes (16*a*) for outwardly fitting and fixing.

Next, the cylindrical main body (14) of the inner tube (16*b*) mounted to one of the adjoining slats (12) is inserted into the cylindrical main body (13) of the outer tube (16*a*)

mounted to another slats (12) from an open end along with the axial direction for fitting the inner tube (16*b*) and the outer tube (16*a*).

Thereafter, upon press fitting end caps (99) of slightly larger outer diameter than the inner diameter of the cylindrical main body (14) onto both ends of the inner tubes (16*b*) (see imaginary line of FIG. 5), the cylindrical main body (14) will slightly increase in diameter such that the cylindrical main body (14) is inwardly contacting an inner peripheral wall of the cylindrical main body (13) of the outer tube (16*a*) to thereby decrease rattling.

In this manner, adjoining slats (12) may be connected in a freely bendable manner through hinge members that are formed of inner tubes (16*b*) and outer tubes (16*a*). By repeating these actions for connecting a plurality of slats (12), the shutter panel (10) in which the slats (12) are connected in a freely bendable manner may be completed.

Since the slats (12), inner tubes (16*b*) and outer tubes (16*a*) are composed to be of separate parts in the present embodiment, overall warpage or local irregularities in thickness or the like owing to shrinkage by cooling and can be prevented when compared to the prior art in which they are integrally formed.

Since the slats (12) are formed of a transparent synthetic resin material, it is possible to see through from the exterior for observing operational conditions of machinery tools installed in the interior of the housing (30) also when the shutter panel (10) is in a closed condition.

A pair of right and left guide rails (41) is mounted to lateral frames (31) forming the frame body (32) of the housing (30) for holding both ends of the shutter panel (10) in a freely sliding manner, wherein both ends of the shutter panel (10) are held by guide grooves (42) formed on opposing surfaces of the guide rails (41).

In such an arrangement, upon grasping a handle (44) provided at a lower end of the shutter panel (10) and pulling the same upward, the shutter panel (10) will be slid upward along the guide rails (41) as illustrated in FIG. 2. With this arrangement, the aperture of the housing (30) will be opened.

Since engaging ribs (22) (27) cutting into front and rear of the slats (12) are formed on opposing inner surfaces of the connecting grooves (21) (25) of the mounting blocks (20) (26) that are formed on the inner tubes (16*b*) and outer tubes (16*a*) in a projecting manner, the slats (12) will be coupled to the connecting grooves (21)(25) in an even firmer manner. Since the inner tubes (16*b*) and outer tubes (16*a*) are fitted to be freely rotating each other, it is possible to eliminate coupling members such coupling shafts for connecting the respective hinge members as it is the case in the second embodiment which will be discussed later in details, and thus to decrease the number of parts constituting the hinge mechanisms.

In the first embodiment, the lengths of the inner tubes (16*b*) and outer tubes (16*a*) are set to be coincident with the entire length of the longer sides of the slats (12), but it is alternatively possible to mount a plurality of outer tubes (16*a*) and inner tubes (16*b*), which are cut to be of shorter lengths of the entire length of the longer side, to the longer sides of the slats (12).

(Second Embodiment)

FIGS. 8 to 11 illustrate a shutter panel according to a second embodiment.

The shutter panel (10) of this embodiment is formed of a plurality of slats (12), connecting tubes (61) of C-shaped section serving as hinge members made of aluminum alloy that are mounted on the longer sides thereof at specified intervals, and coupling shafts (71) having a shape of a round pipe that are inserted into the connecting tubes (61) rotatably.

Figure 8:
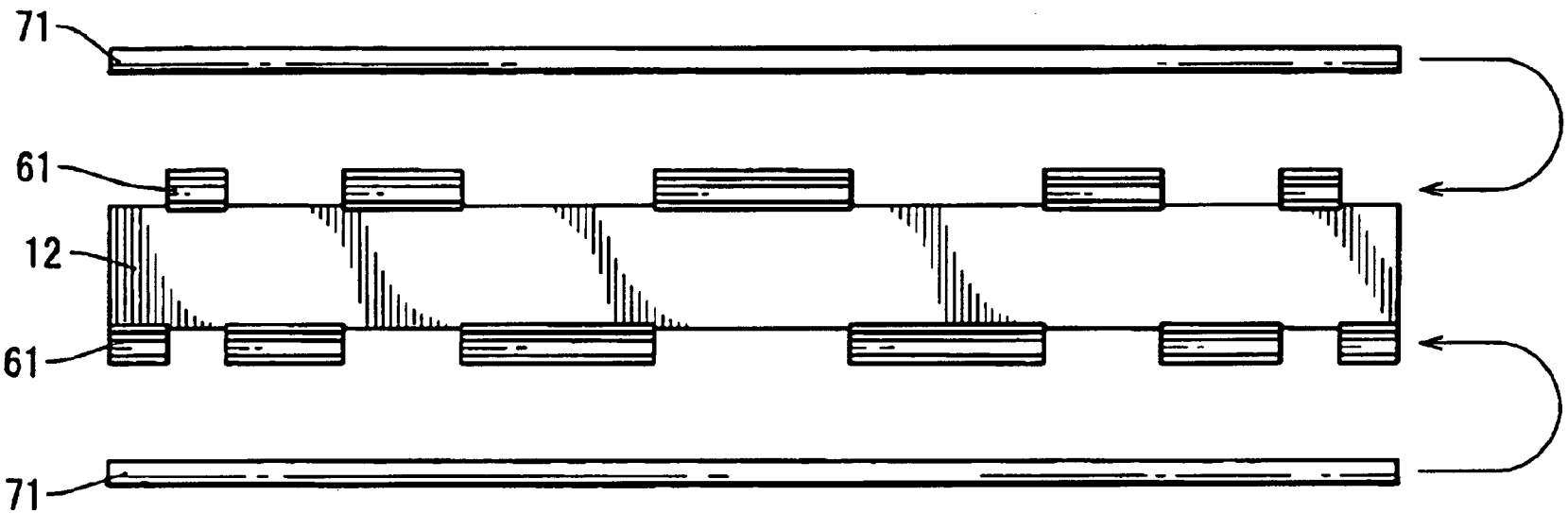
FIG. 8 is a front view illustrating a condition in which connecting tubes (61) are mounted to a slat (12) according to a second embodiment.

As illustrated in FIG. 8, the connecting tubes (61) are arranged in that connecting tubes (61) mounted to one longer side of a slat (12) and connecting tubes (61) mounted to the other side thereof are alternately provided. In the present embodiment, the connecting tubes (61) mounted to central portions of the longer sides of the slats (12) are set to be longer than the connecting tubes (61) that are mounted to the both ends of the longer sides of the slats (12). The reason for mounting the longer connecting tubes (61) to the central portions of the slats (12) is to improve reinforcing effects of the central portions of the slats (12) that are apt to be flexed in width directions.

The intervals between respective connecting tubes (61) are set such that connecting tubes (61) which are mounted to one of the longer sides of the slat (12) to be alternately formed with connecting tubes (61) mounted the other longer side of another slats (12) may just fit into spaces formed between respective connecting tubes (61).

Figure 9:
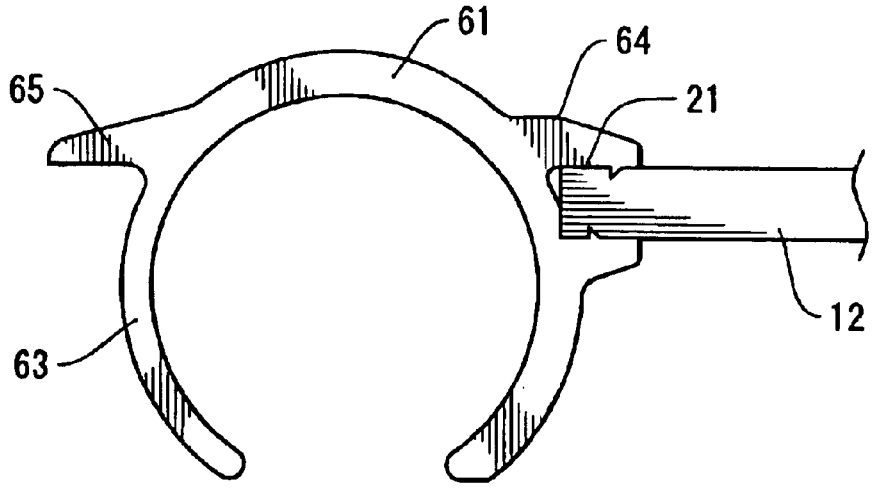
FIG. 9 is an enlarged view of a coupling portion between the slat (12) and the connecting tube (61) according to the second embodiment.

As illustrated in FIG. 9, each cylindrical main body (63) of all of the connecting tubes (61) are formed to be of identical inner diameter and outer diameter, and their outer peripheral surfaces are formed with mounting blocks (64) that are similarly arranged to exhibit the same functions as the mounting blocks (20)(26) as already described with reference to the first embodiment. And cover pieces (65) projecting to a direction opposite to the above mounting blocks (64) are provided on the outer peripheral surface of the connecting tubes (61).

Figure 10:
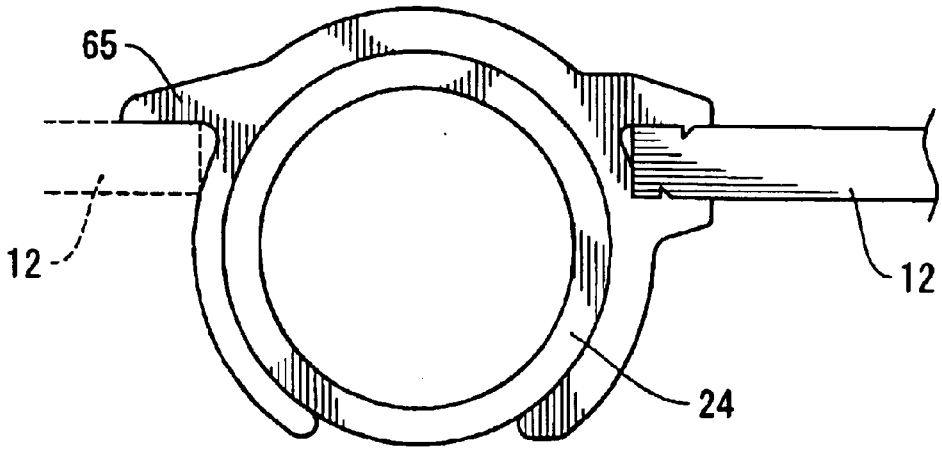
FIG. 10 is a view for explaining actions of a cover (65) formed on the connecting tube (61) applied in the second embodiment.
Figure 11:
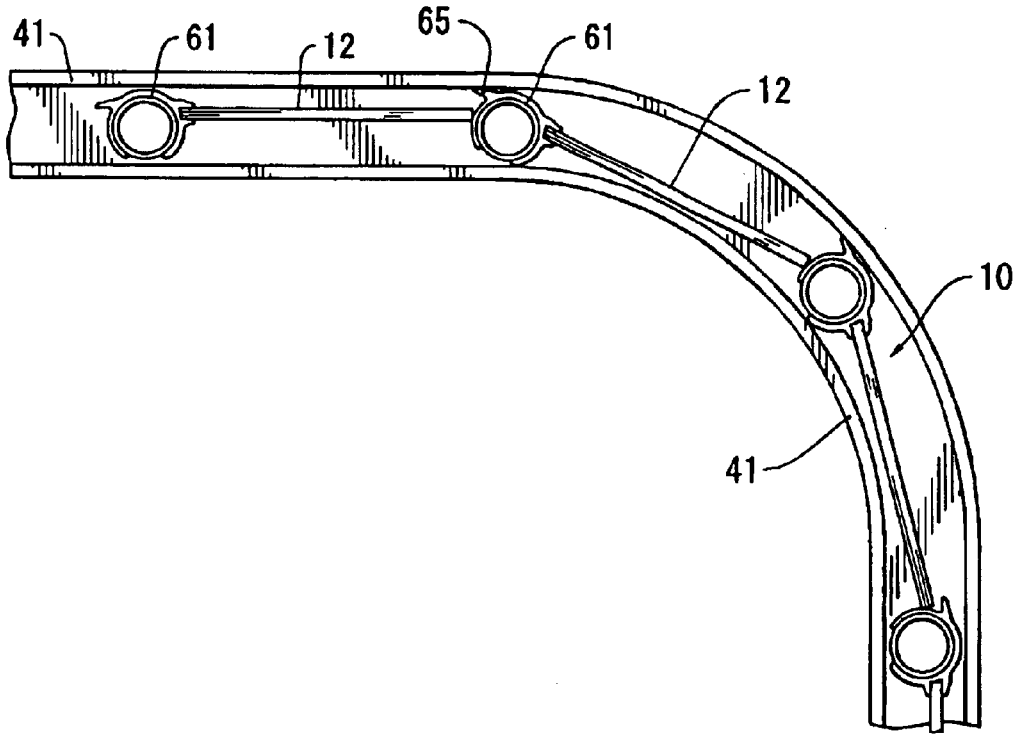
FIG. 11 is a view illustrating a condition in which the shutter panel (10) of the second embodiment is mounted to the guide rails (41).
Figure 12:
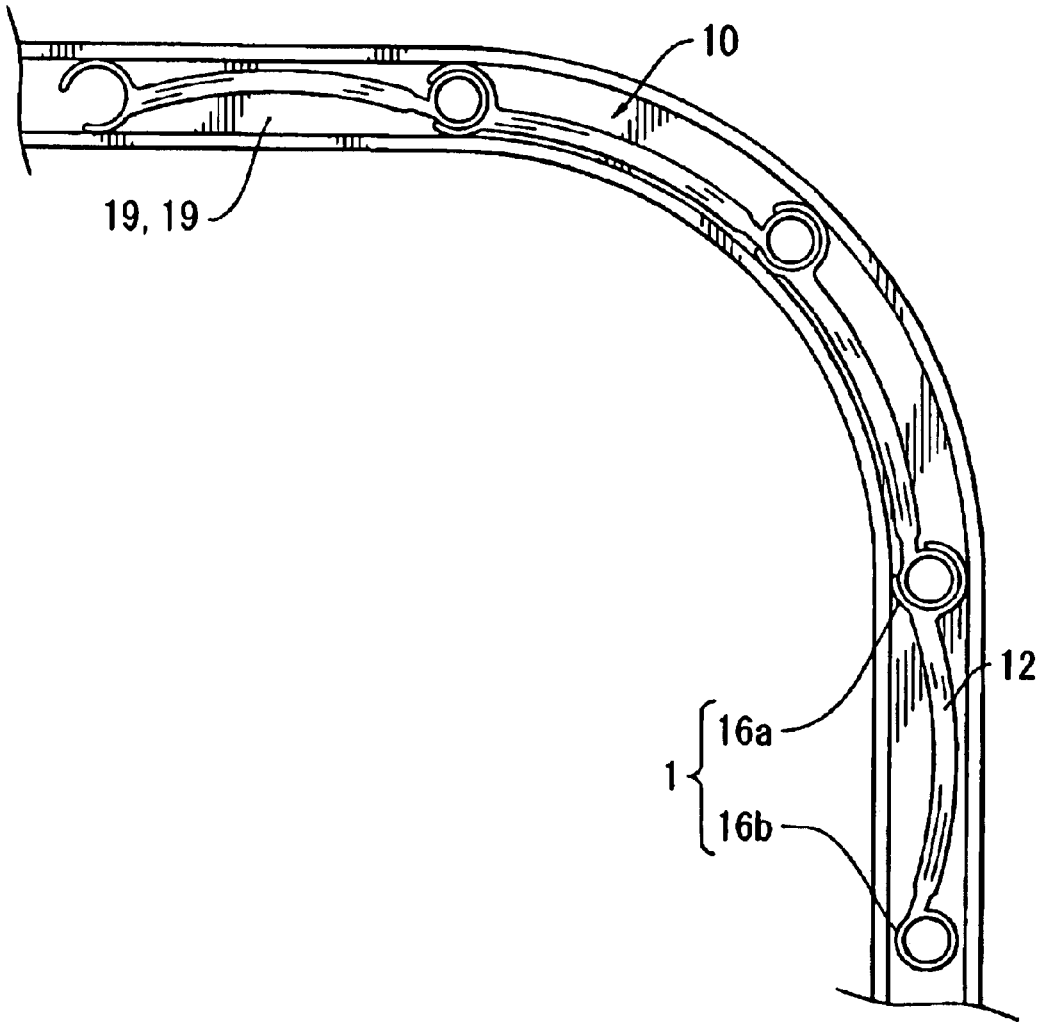
FIG. 12 (PRIOR ART)
FIG. 12 illustrates a Prior Art example.

In case adjoining slats (12) are respectively arranged in a straight line, the cover piece (65) (of one slat) functions to abut an upper surface of an end portion of another slat (12) as illustrated by the broken line as illustrated in FIG. 10 for covering a clearance between the slat (12) and the connecting tube (61), respectively. As illustrated in FIG. 11, the cover piece (65) also acts as a brake for stopping unexpected movements of the shutter panel (10) by abutting against inner walls of arc-like curved portions of the guide rails (41).

In this arrangement, connecting tubes (61) mounted to one slat (12) are inserted between connecting tubes (61) mounted to another adjoining slat (12), and the above-described coupling shaft (71) is inserted into the connecting tubes (61) aligned in series. With this arrangement, adjoining slats (12) are respectively connected in a freely bendable manner via the connecting tubes (61).

It should be noted that while the cylindrical main bodies (63) of the connecting tubes (61) are formed to be of C-shaped sections in this embodiment, the cylindrical main bodies (63) might also be of simple cylindrical shape with no slits being formed on its outer peripheral surface. While the respective connecting tubes (61) are separated from each other, the connecting tubes (61) might also be integrated by means of clearance maintaining members to be aligned in an axial direction at specified intervals.

[Others]

While the inner tubes (16*b*), the outer tubes (16*a*) and the connecting tubes (61) constituting the hinge members are formed of aluminum alloy in the above-described embodiments, they may alternatively be formed of other metals or synthetic resin materials.

While the above-described embodiments employ an arrangement in which engaging grooves (17)(18) are formed on front and rear surfaces near the longer sides of the slats (12) and in which engaging ribs (22) (27) for fitting into and engaging with the engaging grooves (17) (18) are formed on the inner tubes (16*b*), the outer tubes (16*a*) or the connecting tubes (61) sides, it is not necessarily required to form the engaging grooves (17) (18) on the end edges of the slats (12). It is alternatively possible to employ an arrangement in which the inner tubes (16*b*), the outer tubes (16*a*) or the connecting tubes (61) are formed of metallic materials wherein the engaging ribs (22) (27) are formed to be of sharp triangular sectional shape so that the sharp tip ends of the engaging ribs (22) (27) will cut into the front and rear of the slats (12) to prevent slipping off when the ends of the slats (12) are forcibly inserted into the connecting grooves (21) (25).

Another alternative would be an arrangement in which engaging ribs are formed on front and rear surfaces of the slats (12) while engaging grooves (17)(18) are formed on connecting grooves (21)(25) of the inner tubes (16*b*), the outer tubes (16*a*) or the connecting tubes (61) for engaging with the engaging ribs (22)(27).

It is not necessarily required to form the inner tubes (16*b*), the outer tubes (16*a*), the connecting tubes (61) and the slats (12) with the engaging ribs (21) (27) or engaging grooves (17) (18).

What is claimed is:

1. A shutter panel having hinge mechanisms and adjoining slats, said adjoining slats having two respective longer sides, said slats being made of synthetic resin and being connected by hinge mechanisms to be freely bendable, each said hinge mechanism including a first hinge tube member and a second hinge tube member, said first and second hinge tube members being arranged in a coaxial manner with the first hinge tube member partially concentrically surrounding the second hinge tube member so that the hinge tube members are freely rotatable with respect to one another, wherein each hinge tube member has a connecting groove that is opened outwardly and that is formed integrally therewith, and wherein one of the longer sides of each adjoining slat is fitted and coupled into and engaged respectively with said connecting groove in one of said first hinge tube members, and the other of the longer sides is fitted and coupled into and engaged respectively with said connecting groove in one of said second hinge tube members.

2. The shutter panel according to claim 1, wherein slip-off preventing protrusions that cut into surfaces of said slats are formed on opposing inner surfaces of said connecting grooves.

3. The shutter panel according to claim 1, wherein said one hinge tube member is a cylindrical body with said connecting groove being formed on its outer peripheral surface along an axial direction, and wherein said another hinge tube member is a cylindrical body having a C-shaped section that is fitted on said one hinge tube member in a coaxial manner to be freely rotating with said connecting groove being formed on its outer peripheral surface along an axial direction.

4. The shutter panel according to claim 2, wherein said one hinge tube member is a cylindrical body with said connecting groove being formed on its outer peripheral surface along an axial direction, and wherein said another hinge tube member is a cylindrical body having a C-shaped section that is fitted on said one hinge member in a coaxial manner to be freely rotating with said connecting groove being formed on its outer peripheral surface along an axial direction.

5. The shutter panel according to claim 1, wherein said one hinge tube member and said another hinge tube member comprise a pair of cylindrical bodies in which said connecting groove are formed on outer peripheral surfaces thereof along an axial direction and in which a common coupling shaft is inserted into said cylindrical bodies.

6. The shutter panel according to claim 2, wherein said one hinge tube member and said another hinge tube member are a pair of cylindrical bodies in which said connecting groove are formed on outer peripheral surfaces thereof along an axial direction and in which a common coupling shaft is inserted into said cylindrical.

7. The shutter panel according to claim 1, wherein the slats are formed of transparent synthetic resin material.

8. The shutter panel according to claim 2, wherein the slats are formed of transparent synthetic resin material.

9. The shutter panel according to claim 3, wherein the slats are formed of transparent synthetic resin material.

10. The shutter panel according to claim 4, wherein the slats are formed of transparent synthetic resin material.

11. The shutter panel according to claim 5, wherein the slats are formed of transparent synthetic resin material.

12. The shutter panel according to claim 6, wherein the slats are formed of transparent synthetic resin material.

* * * * *